US005204934A

United States Patent [19]

Hermes

[11] Patent Number: 5,204,934

[45] Date of Patent: Apr. 20, 1993

[54] SOUND SYNTHESIS DEVICE USING MODULATED NOISE SIGNAL

[75] Inventor: Dirk J. Hermes, Eindhoven, Netherlands

[73] Assignee: U.S. Philips Corporation, New York, N.Y.

[21] Appl. No.: 591,904

[22] Filed: Oct. 2, 1990

[30] Foreign Application Priority Data

Oct. 4, 1989 [NL] Netherlands ..... 8902463

[51] Int. Cl.[5] ..... G10L 9/14

[52] U.S. Cl. ..... 395/2

[58] Field of Search ..... 381/51-53, 381/29-46; 395/2

[56] References Cited

U.S. PATENT DOCUMENTS

| | | | |
|---|---|---|---|
| 4,344,148 | 8/1982 | Brantingham et al. | 381/51 |
| 4,542,524 | 9/1985 | Laine | 381/53 |
| 4,797,926 | 1/1989 | Bronson et al. | 381/51 |
| 5,005,204 | 4/1991 | Deaett | 381/51 |
| 5,048,088 | 9/1991 | Taguchi | 381/36 |

*Primary Examiner*—Michael R. Fleming
*Assistant Examiner*—Michelle Doerrler
*Attorney, Agent, or Firm*—Bernard Franzblau

[57] ABSTRACT

A device for sound synthesis intended to generate a desired acoustic signal includes a first signal source which emits a periodic signal having a given repetition frequency as a representation of the voiced parts of the desired acoustic signal, a second signal source which emits an aperiodic signal or a noise signal as a representation of the unvoiced parts of the desired sound signal, a combination circuit which combines the signals of the two signal sources with each other, and a filter circuit having a variable transmission function for processing the combined signal into the desired output signal. A third signal source emits a modulated noise signal consisting of a train or sequence of noise bursts of comparatively short duration, whose temporal envelope is synchronous with the temporal envelope of the periodic signal and which invariably have at least approximately the same energy. The modulated noise signal is supplied, together with the signal of the first signal source, to a further combination circuit.

16 Claims, 1 Drawing Sheet

SOUND SYNTHESIS DEVICE USING MODULATED NOISE SIGNAL

BACKGROUND OF THE INVENTION

This invention relates to a device for sound synthesis intended to generate a desired acoustic signal, comprising:

a first signal source intended to emit during operation a periodic signal having a given repetition frequency as a representation of the voiced parts of the desired acoustic signal, a second signal source intended to emit during operation an aperiodic signal or a noise signal as a representation of the unvoiced parts of the desired sound signal, a combination circuit intended to combine the signals of the two signal sources with each other, and a filter circuit having a variable transmission function intended to process the combined signal to derive the desired output signal.

Such a device has been described, for example, by J. Makhoul et al in the article "A mixed-source model for speech compression and synthesis", published in the Proceedings of 1978, I.E.E.E. International Conference on Acoustics, Speech and Signal Processing, Apr. 10–12, 1978, Tulsa, Okla. In this known device, besides the said signal sources, the combination circuit and the variable filter circuit, a low-pass filter is connected between the first signal source and the combination circuit and a high-pass filter is connected between the second signal source and the combination circuit.

A similar device has been described by S. H. Kwon and A. J. Goldberg in the article "An enhanced LPC vocoder with no voiced/unvoiced switch", published in I.E.E.E. Transactions on Acoustics, Speech and Signal Processing, Vol. ASSP-32, No. 4, 1984, p. 851 ff. In this known device, in addition to the said components a controlled amplifier is provided behind both the first signal source and the second signal source. Both amplifiers are controlled by a signal originating from the filter circuit having a variable transmission function in a manner such that the combination circuit can be reduced to a simple hybrid circuit.

All of these known devices have for their object to generate a speech signal having the highest possible perception quality. In practice, however, it has been found that none of the known devices reaches a speech quality which still does not require any further improvement.

SUMMARY OF THE INVENTION

An object of the invention is to indicate the manner in which a device for sound synthesis should to be constructed in order to attain a substantial improvement with respect to the known devices.

According to the invention, a device for sound synthesis of the kind mentioned in the opening paragraph is characterized in that the device is provided with a third signal source intended to emit, during operation, a modulated noise signal consisting of a train or sequence of noise pips of comparatively short duration, whose temporal envelope is synchronous with the temporal envelope of the said periodic signal and which invariably have at least approximately the same energy, which modulated noise signal is supplied, during operation, together with the signal of the first signal source, to the combination circuit.

In the known devices, stationary noise is added to the voiced periodic signal. It has been found that a listener listening to the ultimate acoustic signal produced by one of the known devices gets the impression that the noise signal originates from a separate source, which is clearly different from the source emitting the periodic signal. In other words, the perception quality is comparatively poor. This situation is improved, it is true, by the addition of a high-pass or a low-pass filter as described by Makhoul, but this device also requires improvement.

According to the invention, when noise is now added in the form of a sequence or train of noise pips, whose temporal envelope satisfies the aforementioned condition and which invariably have (at least approximately) the same energy, a perceptive fusion of the noise with the voiced periodic signal is effectively obtained, as a result of which a considerable improvement of the perception quality is attained.

Although the aforementioned prior art more particularly relates to devices for generating speech signals, the present invention is not limited thereto. The device according to the invention can be used successfully for synthesizing, for example, musical sounds. By way of example, mention may be made of the sound of a German flute, which sound has a "hoarse timbre". In the known music synthesis techniques, this hoarse character is obtained by adding comb-filtered noise or by adding inharmonic components to the start of the sound. However, the use of the present invention leads to a much more satisfactory result.

In connection with the general applicability of the invention, it should be noted that in this description the term "voiced" relates to non-noisy signal parts and the term "unvoiced" relates to noisy signal parts.

According to a further developed embodiment of the device according to the invention, the two noise sources are combined with each other.

BRIEF DESCRIPTION OF THE DRAWING

The invention will now be described more fully with reference to the accompanying drawing, in which.

DESCRIPTION OF THE PREFERRED EMBODIMENTS

Figure 1:
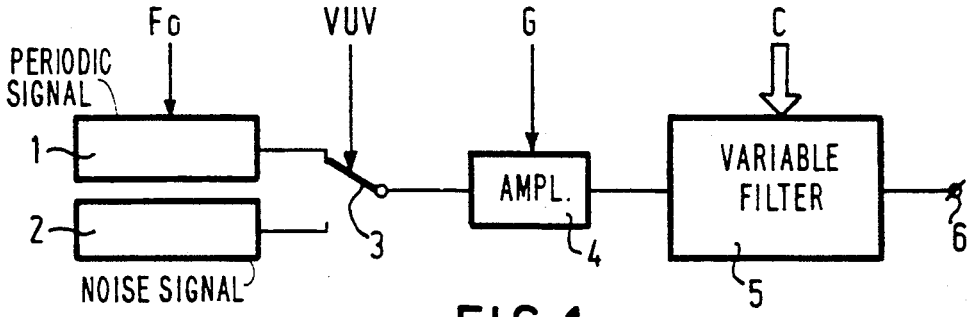
FIG. 1 PRIOR ART
FIG. 1 shows a device known from the prior art.

The device shown in FIG. 1 comprises a first signal source 1 intended to emit during operation a periodic signal, more particularly a pulse train having a given repetition frequency $F_o$. The device further comprises a second signal source 2 intended to emit an aperiodic signal, more particularly a noise signal. The outputs of the two signal sources 1 and 2 are connected to the inputs of a combination circuit, which is indicated in outline in FIG. 1 by means of a switch 3, which is controlled by a VUV signal. This VUV signal determines whether a voiced sound segment or an unvoiced sound segment has to be generated. The output signal of the combination circuit 3 is supplied to an amplifier stage 4 having a variable amplification factor G. The signal G influences the amplitude of the combined signal as a function of time. The output signal of the amplifier stage 4 is supplied to a variable filter 5; to which the filter coefficients C can be supplied from the outside. This filter circuit consists in practical embodiments of a cascade arrangement of a number of secondorder subfilters each of which is intended to modulate one of the formants or resonance frequencies which can occur within the band-width range chosen.

Figure 2:
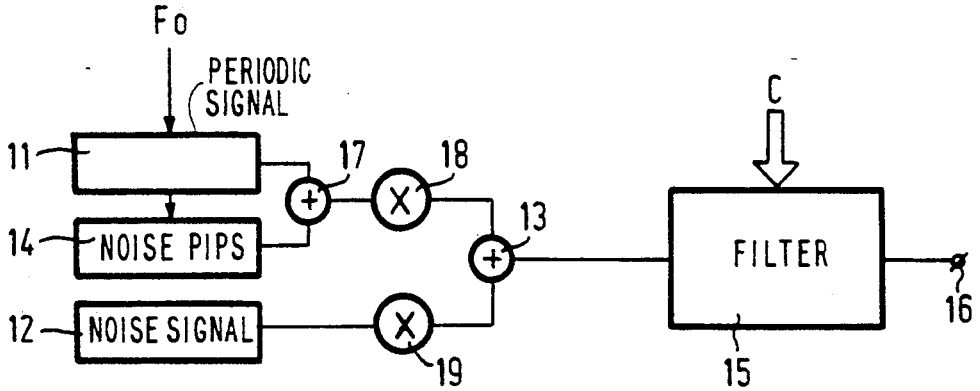
FIG. 2 shows a first embodiment of a device according to the invention.

FIG. 2 shows a first embodiment of a device according to the invention. Like the device of FIG. 1, the device of FIG. 2 is also provided with a first signal source 11 intended to emit a periodic signal having a given repetition frequency $F_o$, a second signal source 12 intended to emit during operation an aperiodic signal or a noise signal, a combination circuit 13, in this case in the form of a summator, and a filter circuit 15, which also in this case is provided with a number of subfilters intended to form the different formants in the bandwidth range chosen. In conformity with the invention, the device of FIG. 2 is further provided with a third signal source 14, which emits a train or a sequence of noise pips, whose envelope is synchronous with the temporal envelope of the signal emitted by the first signal source 11. In other words: the noise pips or trains of noise emitted by the source of noise 14 occur at a repetition frequency $F_o$ and, moreover, all of the noise pips have at least substantially the same energy. The output signals of the signal sources 11, 14 are combined with each other in the summator 17 and are amplified or attenuated, if required, in an amplifier stage 18 and the amplified or attenuated signal is supplied to the combination circuit 13. The combination circuit 13 also receives the noise signal from the source or noise 12, the amplitude of which noise signal can also be influenced via an amplifier/attenuator stage 19. In the same manner as in FIG. 1, the output signal of the combination circuit 13 is also supplied to a variable filter circuit 15, whose filter coefficients C can be supplied from the outside. The synthetic acoustic signal is supplied to the output 16.

By means of the device according to the invention, a much more natural sound is produced than is possible with the devices according to the prior art. With the use of the device for generating synthetic speech signals, vowels are produced having such a (hoarse) timbre that even in ideal conditions (for example, when listening to the speech signal via a high-quality headphone) the vowels cannot or can substantially not be distinguished from the natural vowels giving in general a more or less hoarse impression. With the use of the device, for example, for music synthesis, a music signal is also obtained having such a "hoarse" timbre giving a natural impression that even the trained listener cannot or can substantially not distinguish this synthesized signal from a music signal produced by a real musical instrument. In other words, the device according to the invention brings about a perceptible timbre variation in such a sense that the timbre becomes "more noisy" or "more hoarse".

The noise pips can be obtained in that the output signal of a source of noise emitting a noise signal having the same energy content as a function of time is passed through a filter which is constructed so that the filtered signal has an energy varying in time according to a predetermined envelope. It is then to be preferred that the instant in the period at which the energy of the noise is maximal coincides more or less with the instant in the period at which the energy of the periodic signal is maximal.

The Applicant has carried out practical experiments in which the envelope used is a cosine square window, but within the scope of the invention other filter types may also be used, for example a Gaussian filter, a Hamming filter, a Hanning filter, a Tukey filter, etc.

Figure 3:
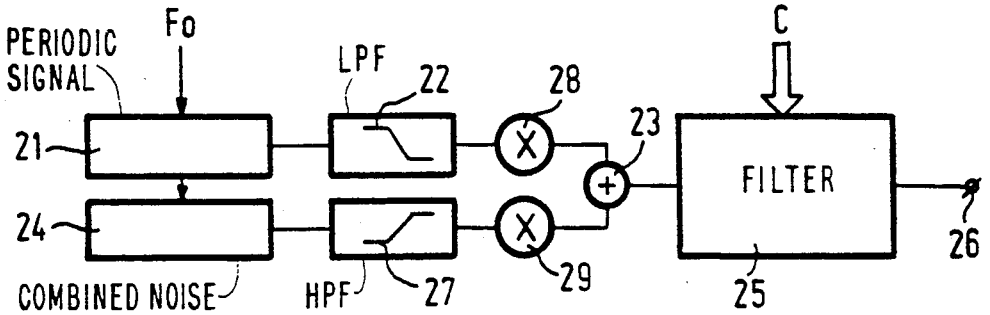
FIG. 3 shows a second embodiment of a device according to the invention.

Another embodiment of the device according to the invention is shown in FIG. 3. In FIG. 3, the two sources of noise 14 and 12 of FIG. 2 are combined into a single source of noise 24. This source of noise 24 emits a noise signal modulated in time, the temporal envelope of this noise signal having a repetition frequency $F_o$ so that the temporal envelope of the noise pips occurring in this noise signal is synchronous with the temporal envelope of the periodic signal emitted by the first signal source 21. This first signal source 21 is again comparable with the source 11 in FIG. 2. The output signal of the first signal source 21 is subjected to a low-pass filter operation in the filter circuit 22, is then amplified or attenuated in the amplifier/attenuator 28 and is supplied to the combination circuit 23. The output signal of the noise generator 24 is subjected to a high-pass filter operation in the filter circuit 27, is then amplified or attenuated in the amplifier/attenuator 29 and is also supplied to the combination circuit 23. The output signal of the combination circuit 23 is supplied, as in the embodiment of FIG. 2, to a filter stage 25, whose filter effect depends upon the externally supplied filter coefficients C and the ultimate synthetic acoustic signal is supplied to the output 26.

It should finally be noted that in FIG. 1 an amplifier stage is used having a variable amplification factor G. A similar amplifier stage may of course also be included in FIG. 2 and FIG. 3. In FIGS. 2 and 3, such an amplifier stage would have to be included between the combination circuit 13 and 23, respectively, and the filter circuit 15 and 25, respectively. It is also possible in this case to construct the combination circuit 13 and 23, respectively, so that the variable amplification function is realized therein.

It should further be noted that only in the embodiment of FIG. 3 is use made of a low-pass filter 22 and a high-pass filter 27. Such filters may also be used, if required, in the embodiment of FIG. 2, in which event these filters are connected in series with the amplifier stages 18 and 19, respectively, or are integrated, if possible, in these amplifier stages 18 and 19.

I claim:

1. A device for sound synthesis intended to generate a desired acoustic signal comprising:

a first signal source which, during operation, emits a periodic signal having a given repetition frequency as a representation of the voiced parts of the desired acoustic signal, a second signal source which, during operation, emits an aperiodic signal or a noise signal as a representation of the unvoiced parts of the desired acoustic signal, a combination circuit for combining the signals of the two signal sources with each other, a filter circuit having a variable transmission function for processing the combined signal into the desired output signal, and a third signal source which, during operation, emits a modulated noise signal comprising a train or sequence of noise pips of comparatively short duration, whose temporal envelope is synchronous with the temporal envelope of said periodic signal and which noise pips invariably have at least approximately the same energy, and wherein the modulated noise signal is supplied, during operation, together with the signal of the first signal source to the combination circuit.

2. A device as claimed in claim 1, wherein the modulation of the noise signal supplied by the third signal source is such that the instant in the period at which the energy in the modulated noise signal is a maximum coincides at least approximately with the instant in the period at which the energy of the periodic signal is a maximum.

3. A device as claimed in claim 2, wherein the second and the third signal source are combined with each other.

4. A device as claimed in claim 1, wherein the second and the third signal source are combined with each other.

5. A device as claimed in claim 1 comprising a second combination circuit which combines the signals of the first signal source and the third signal source and supplies a combination signal thereof as one of the two signals of the two signal sources which are combined by the first combination circuit.

6. A device as claimed in claim 4 wherein the second and third signal sources are combined to form a further signal source and the device further comprises a low pass filter connected in cascade between the first signal source and the combination circuit and a high pass filter connected in cascade between the further signal source and the combination circuit.

7. A device as claimed in claim 1 wherein the variable transmission function of the filter circuit is controlled by a parameter derived externally of the filter circuit and determined by coefficients of the filter.

8. A device as claimed in claim 2 wherein the variable transmission function of the filter circuit is controlled by coefficients of a parameter derived externally of the filter circuit and determined by the filter.

9. A sound synthesis device for generating a desired acoustic signal comprising:

a first signal source for producing a periodic signal of a given frequency and which is representative of voiced parts of the desired acoustic signal, a second signal source for producing an aperiodic signal which is representative of unvoiced parts of the desired acoustic signal, a third signal source for producing a modulated noise signal comprising a sequence of noise bursts of relatively short duration and with a temporal envelope synchronous with a temporal envelope of said periodic signal and wherein each of the noise bursts have approximately the same energy, signal combining means responsive to said periodic signal, said aperiodic signal and said noise bursts so as to derive a combined signal, and a variable transmission filter circuit which processes the combined signal to derive at an output of said filter circuit the desired acoustic signal.

10. A device as claimed in claim 9 wherein said aperiodic signal comprises a noise signal.

11. A device as claimed in claim 10 wherein the second and third signal sources are combined to form a single noise signal source and the device further comprises a low-pass filter connected in cascade between the first signal source and the signal combining means and a high-pass filter connected in cascade between the single noise signal source and the signal combining means.

12. A device as claimed in claim 11 further comprising first and second amplifier/attenuator circuits connected in cascade with the low-pass filter and the high-pass filter, respectively.

13. A device as claimed in claim 12 wherein the signal combining means provides a variable gain function.

14. A device as claimed in claim 9 wherein the third signal source produces a modulated noise signal in which a maximum in the energy of the modulated noise signal coincides in time with a maximum in the energy of the periodic signal.

15. A device as claimed in claim 9 wherein said signal combining means comprises, a first combination circuit coupled to respective outputs of the first and third signal sources, and a second combination circuit coupled to respective outputs of the first combination circuit and the second signal source.

16. A device as claimed in claim 9 wherein the variable transmission function of the filter circuit is controlled by an externally derived parameter.

* * * * *

UNITED STATES PATENT AND TRADEMARK OFFICE

CERTIFICATE OF CORRECTION

PATENT NO. : 5,204,934

DATED : 4/20/93

INVENTOR(S) : Dirk J. Hermes

It is certified that error appears in the above-indentified patent and that said Letters Patent is hereby corrected as shown below:

Column 5:

Claim 8, line 3, delete "coefficients of";
line 4, after "by" insert --coefficients of--.

Signed and Sealed this
Fifth Day of April, 1994

Bruce Lehman

*Attest:*

BRUCE LEHMAN

*Attesting Officer*

*Commissioner of Patents and Trademarks*